United States Patent [19]

Budzinski

[11] Patent Number: 4,538,041

[45] Date of Patent: Aug. 27, 1985

[54] ROTATING INDUCTION HEATING APPARATUS

[75] Inventor: Roger R. Budzinski, Seven Hills, Ohio

[73] Assignee: Park-Ohio Industries, Inc., Shaker Heights, Ohio

[21] Appl. No.: 525,996

[22] Filed: Aug. 24, 1983

[51] Int. Cl.[3] ..... H05B 6/14

[52] U.S. Cl. ..... 219/10.75; 219/10.57; 219/10.79; 219/10.49 R; 266/129

[58] Field of Search ..... 219/10.57, 10.49 R, 219/10.49 A, 10.79, 10.75, 10.67, 10.43; 266/129

[56] References Cited

U.S. PATENT DOCUMENTS

| | | | |
|---|---|---|---|
| 3,443,049 | 5/1969 | Hoagland | 219/10.79 X |
| 3,686,459 | 8/1972 | Lewis | 219/10.57 |
| 3,696,224 | 10/1972 | Lewis | 219/10.57 |
| 4,292,489 | 9/1981 | Gerber | 219/10.79 X |
| 4,438,310 | 3/1984 | Cachat | 219/10.57 X |

*Primary Examiner*—Philip H. Leung
*Attorney, Agent, or Firm*—Body, Vickers & Daniels

[57] ABSTRACT

Apparatus for inductively heating a non-rotating workpiece includes a rotatable spindle of insulating material having a split-ring secondary mounted thereon for rotation therewith and which secondary has opposite ends electrically connected in series with the opposite ends of a multiple turn inductor coil. A primary winding in the form of a split-ring is supported in fixed coaxial relationship with respect to the spindle and the secondary ring thereon, and opposite ends of the primary ring are connected across a source of high frequency alternating current. The apparatus is mounted on a slide for displacement toward and away from a workpiece to selectively position the inductor in magnetically coupled relationship with the workpiece, whereby the workpiece is inductively heated in response to rotation of the spindle and energization of the primary ring. The ends of the secondary ring are electrically connected with the ends of the inductor through corresponding conductor bars, and the conductor bars and secondary ring are provided with fluid flow passageways for the continuous circulation of coolant therethrough and through the inductor between coolant supply and return lines of a fluid coupling assembly mounted on the end of the spindle opposite the inductor. The fluid coupling assembly also supplies cooling and quenching liquid through the spindle to the inductor.

26 Claims, 9 Drawing Figures

ROTATING INDUCTION HEATING APPARATUS

BACKGROUND OF THE INVENTION

This invention relates to the art of induction heating apparatus and, more particularly, to improved apparatus for inductively heating surfaces of non-rotating workpieces.

It is of course well known to inductively heat and quench the surfaces of workpieces by rotating the workpieces relative to a stationary inductor coil. Often, however, rotation of the workpiece is not easily achieved, or is impractical, such as for example where the surfaces of the workpieces to be heated are eccentric with respect to the axis of the workpiece and/or where the heat treating operation is at one stage of a automated multi-stage machine wherein the workpiece is held by stationary fixtures against rotation while operations are performed thereon by rotating cutting tools and the like. Accordingly, it becomes desirable in these and other situations to achieve heat treating by rotating the inductor relative to the workpiece. Rotatable inductor arrangements have been provided heretofore for the latter purpose, but such prior arrangements have included the use of slip rings or mercury wetted contacts to convey the high currents from the power source to the inductor coil. Such arrangements are inefficient with respect to conducting high currents, are difficult to maintain and are structurally complex. Additionally, mercury is a toxic substance whereby its use in such arrangements is hazardous to personnel operating the equipment.

SUMMARY OF THE INVENTION

The foregoing and other disadvantages of rotary inductors heretofore provided are overcome by the present invention wherein a rotatable spindle on which the inductor is mounted is provided with a split conductor ring or sleeve of plate material mounted on the spindle for rotation therewith and having each of its opposite ends connected to a corresponding one of the opposite ends of the inductor. A fixed split conductor ring or sleeve of plate material extends about the spindle and is concentric and axially aligned with the split-ring carried by the spindle, and the opposite ends of the fixed conductor ring are connected across a source of high frequency alternating current. The fixed conductor ring acts as the primary of a transformer, and the split-ring conductor on the spindle acts as the secondary of the transformer for supplying alternating current to the inductor upon energization of the primary. Preferably, in order to increase the efficiency of inducing current in the secondary ring, flux intensifiers are provided on the spindle to extend about a substantial portion of the inner diameter of the secondary ring and on the primary ring to extend about the outside diameter thereof.

In a preferred embodiment, the spindle and fixed conductor ring are supported on a slide for axial reciprocation as a unit, thus to enable the selective positioning of the inductor in magnetically coupled relationship with a non-rotating workpiece held coaxial therewith for the latter to be inductively heated in response to rotation of the spindle and energization of the primary. Further in accordance with a preferred embodiment, the conductor ring providing the secondary winding has its opposite ends connected to the inductor through bus bars extending along the spindle, and the bus bars and secondary ring are provided with coolant passageways for the continuous circulation of cooling liquid therethrough and through the inductor. Circulation of coolant is facilitated by a fluid coupling unit on the end of the spindle opposite the inductor and a unique and efficient arrangement for flowing coolant from the coupling to and through the secondary and inductor and back to the coupling. Further, the spindle preferably has a central passageway therethrough between its opposite ends and opening axially outwardly at the end carrying the inductor to enable liquid flow through the spindle from the fluid coupling for cooling and/or quench harding a workpiece.

The primary object of the present invention is the provision of a rotatable inductor unit which is structurally simple and provides improved efficiency with respect to conducting alternating current to the rotating inductor component of the unit.

Another object is the provision of a rotating inductor unit in which the inductor component is mounted on a spindle for rotation therewith and in which current is conducted to the inductor component by means of a split conductor ring mounted on the spindle for rotation therewith and which acts as the secondary of a transformer in which the primary is defined by a fixed split conductor ring coaxial with the secondary ring and connected to a source of high frequency alternating current, thus to enable the inductive heating of a workpiece in response to rotation of the spindle and energization of the primary.

Still another object is the provision of a rotating inductor unit of the foregoing character with a unique arrangement for continuously circulating cooling liquid through the split-ring secondary and inductor component during rotation of the spindle.

BRIEF DESCRIPTION OF THE DRAWINGS

The foregoing and other objects and advantages will in part be obvious and in part pointed out more fully hereinafter in connection with the written description of a preferred embodiment illustrated in the accompanying drawings in which.

Figure 1:
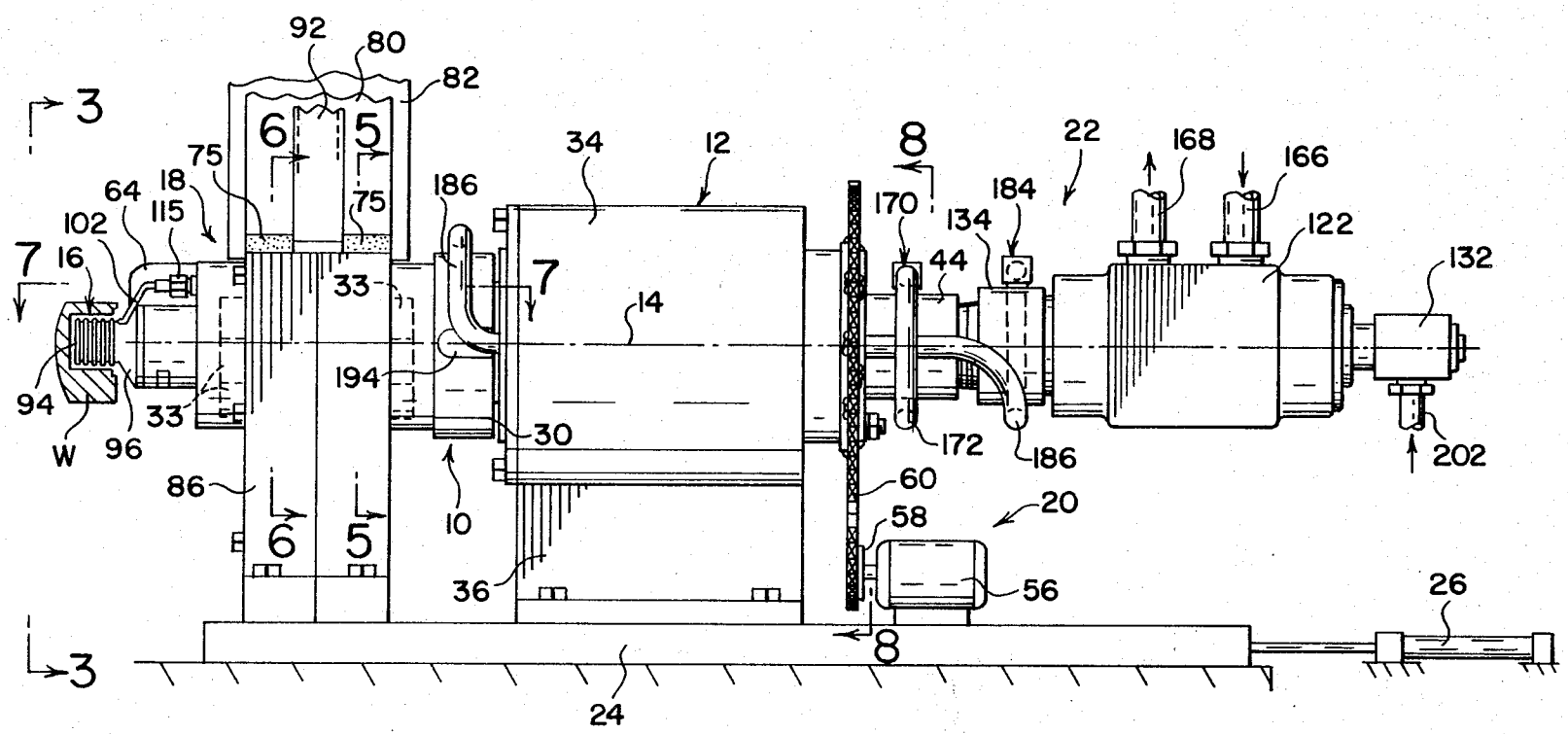
FIG. 1 is a side elevation view of induction heating apparatus in accordance with the present invention.
Figure 2:
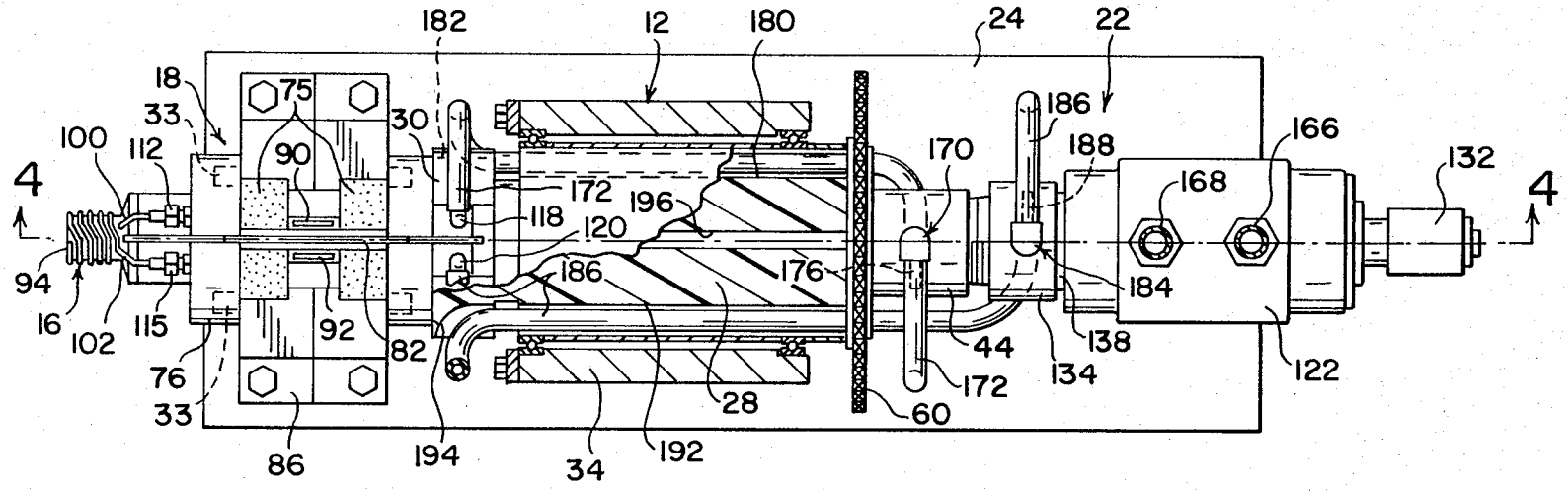
FIG. 2 is a plan view, partially in section, of the apparatus illustrated in FIG. 1.
Figure 3:
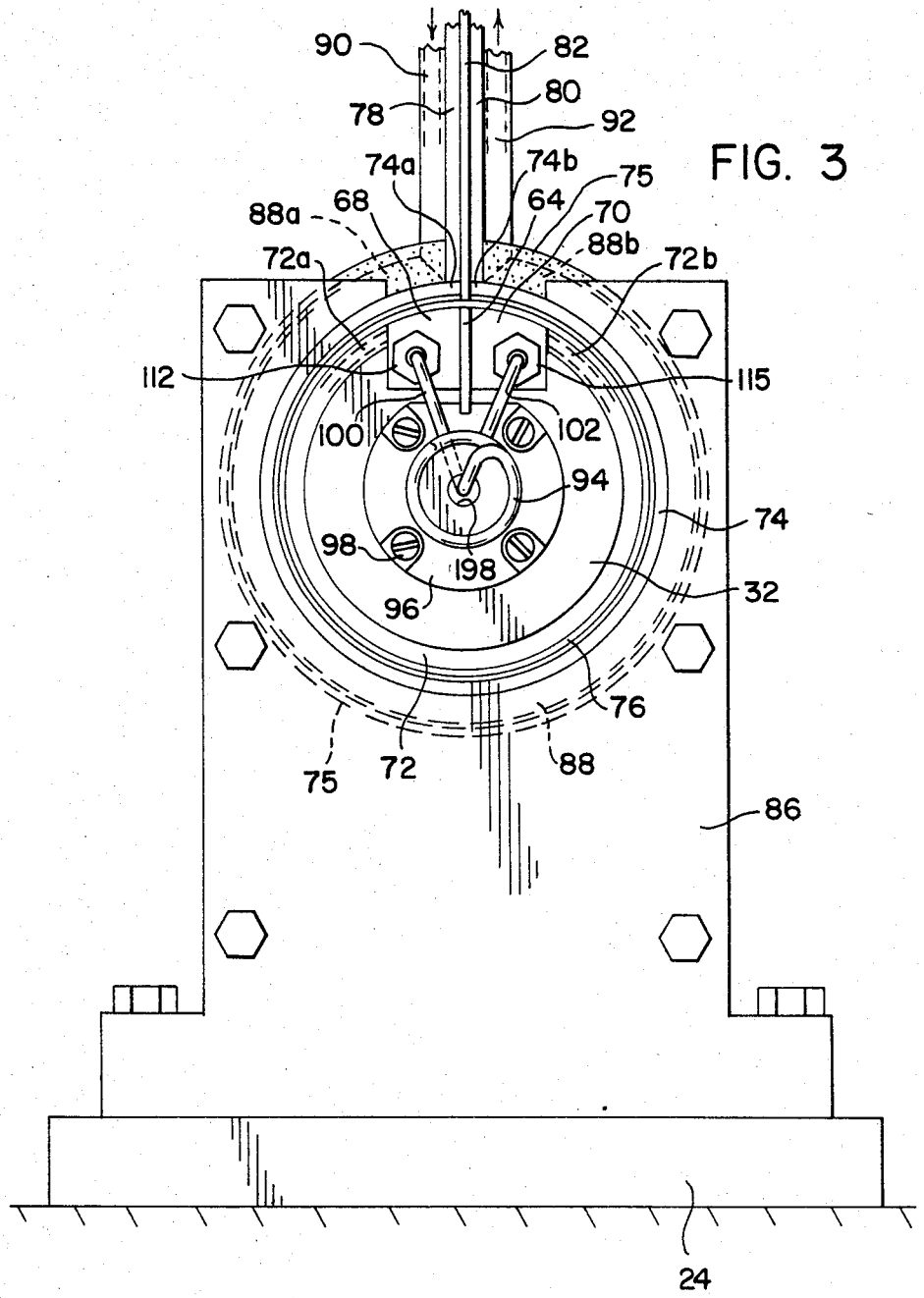
FIG. 3 is an end elevation view of the apparatus as seen along line 3—3 in FIG. 1.

Referring now in greater detail to the drawings, wherein the showings are for the purpose of illustrating a preferred embodiment of the invention only and not for the purpose of limiting the invention, rotatable induction heating apparatus in accordance with the present invention includes a spindle 10, a bearing assembly 12 supporting the spindle for rotation about an axis 14, an inductor assembly 16 supported on one end of spindle 10 for rotation therewith, a power unit 18 for energizing the inductor, a drive unit 20 at the opposite end of the spindle for imparting rotation thereto, and a hydraulic coupling unit 22 at the latter end of the spindle for supplying cooling and quenching water to and through the spindle and inductor. To facilitate axial reciprocation of the apparatus toward and away from a workpiece W supported coaxially therewith, a fixed portion of power unit 18 to be described hereinafter, drive unit 20 and hydraulic coupling unit 22 are each mounted on a base or slide member 24 which is suitably supported for longitudinal reciprocation in the direction of axis 14. A suitable drive arrangement such as a pneumatic piston and cylinder unit 26 is provided for imparting reciprocation to the slide. Such reciprocating support and drive arrangements are well known and accordingly need not be shown or described in detail. It will be appreciated of course that workpiece W in accordance with the present invention is suitably supported for the interior surface thereof to be coaxial with axis 14 and for the workpiece to be held against rotation relative to the latter axis.

Spindle 10 is constructed of a suitable plastic or composite insulating material and has a cylindrical inner end portion 28 supported in bearing unit 12, an intermediate collar portion 30, and an axially outer end portion 32 which supports inductor assembly 16 and a portion of power unit 18 by which the inductor is energized, all as described in greater detail hereinafter. Spindle portion 28 is received in a housing or sleeve component 34 of bearing assembly 12, and which sleeve is mounted on slide plate 24 for displacement therewith and against rotation relative thereto by means of a suitable housing 36 secured to the slide plate. Annular bearing ring units 38*a* and 38*b* are interposed between the interior of sleeve 34 and spindle portion 28 adjacent the axially opposite ends of sleeve 34 to support the spindle for rotation, and the bearing units are axially spaced apart such as by a spacer sleeve 40 interposed therebetween and extending about spindle portion 28. Drive unit 20 includes a sprocket wheel 42 welded or otherwise secured on annular hub member 44 by which the sprocket wheel is attached to the end of spindle portion 28 for rotating the spindle unit in response to rotation of the sprocket wheel. A second spacer sleeve 41 is interposed between bearing unit 38*b* and hub 44. Hub member 44 is mounted on spindle portion 28 by means of a plurality of rods 46 extending through corresponding openings therefor in spindle portion 28 and the axially outer ends of which rods are threaded to receive mounting nuts 48. The opposite ends of rods 46 are threaded to be received in corresponding internally threaded openings in a retaining ring 50 which axially engages the radially inner component of bearing unit 38*a* at the corresponding end of spindle portion 28. A second retaining ring 52 engages the radially outer component of bearing unit 38*a* and is mounted on the corresponding end of sleeve 34 by mcans of a plurality of threaded fasteners 54 extending through the ring and into threaded openings therefor in sleeve 34. Rings 50 and 52 cooperatively interengage the spindle unit and bearing assembly against relative axial displacement. Drive unit 20 further includes a suitable motor 56 for rotating sprocket wheel 42 and thus spindle 10. Motor 56 is mounted on slide plate 24 for displacement therewith and may, for example, be an electric, air or hydraulic motor. Motor 56 has an output shaft provided with a sprocket wheel 58 drivingly interconnected with sprocket wheel 42 by means of an endless chain 60. While not shown, it will be appreciated that motor 56 is adapted to be selectively energized through appropriate controls to drive sprocket wheel 58 and thus rotate spindle 10 about axis 14.

As best seen from FIGS. 3–6 of the drawing, spindle portion 32 is generally circular in cross-section and includes a longitudinally extending recess providing a planar surface 62 radially spaced from and parallel to axis 14 and extending from the outer end of spindle portion 32 into collar portion 30. A radially outwardly projecting insulating spacer 64 has its lower end suitably secured in a recess 66 in spindle portion 32 and extends longitudinally of surface 62 and is generally coextensive therewith in the latter direction. Power unit 18 includes elongate conductor bars 68 and 70 of copper material which extend longitudinally in the recess along opposite sides of insulating spacer 64, and a split copper plate sleeve member 72 extending about spindle portion 32 coaxial with axis 14 and having circumferentially opposite ends 72*a* and 72*b* respectively electrically connected with the laterally outer sides of conductor bars 68 and 70. Conductor bars 68 and 70 have corresponding outer ends 68*a* and 70*a* and corresponding inner ends 68*b* and 70*b* and sleeve 72 and conductor bars 68 and 70 are suitably secured to spindle portion 32 for rotation therewith and against axial displacement relative thereto. Sleeve 72 acts as a transformer secondary and, for the purpose set forth hereinafter, spindle portion 32 is preferably provided with flux intensifiers 33 which are axially coextensive with sleeve 72 and substantially circumferentially coextensive with respect to the radially inner surface of the sleeve. Such intensifiers are preferably produced from a material such as commercially available Ferocon which consists of metal oxide particles in a non-conductive binder, although it will be appreciated that the flux intensifiers can be in the form of laminations of sheet steel. It will be further appreciated that spindle portion 32 is provided with an axially and circumferentially extending recess 35 for receiving the intensifiers and in which the latter are suitably secured.

Power unit 18 further includes a fixed primary defined in part by a split sleeve 74 of copper plate material which extends about sleeve 72 coaxial with axis 14. Sleeve 74 is radially spaced and insulated relative to sleeve 72 by means of a thin sleeve of insulating material 76 mounted on the outside of sleeve 72 and which is circumferentially continuous so as to extend across the radially outer surfaces of conductor bars 68 and 70 and the radially outer edge of insulating spacer 64. The radial spacing between sleeve 74 and sleeve 72 further provides a slight air gap therebetween, not designated numerically. Sleeve 74 has circumferentially opposite ends 74*a* and 74*b* respectively electrically connected to upwardly extending conductor plates 78 and 80 which are parallel and spaced apart by a sheet of insulating material 82 therebetween, and the upper ends of which plates are connected across a suitable source of high frequency alternating current 84. Sleeve 74 is supported in fixed coaxial relationship with spindle 10 by means of a suitable housing 86 of insulating material, the lower portion of which is mounted on slide plate 24 and the upper portion of which provides a cradle surrounding and supporting sleeve 74 about the majority of the circumferential extent thereof. In the embodiment illustrated, the fixed primary further includes copper tubing 88 of rectangular cross-section which extends circumferentially about the outer side of sleeve 74 and has its opposite ends 88*a* and 88*b* respectively connected to tubing sections 90 and 92 extending upwardly along the outer sides of plates 78 and 80. Tubing 88 and sections 90 and 92 provide for the circulation of cooling liquid about the primary and, while not shown, the upper ends of sections 90 and 92 are adapted to be connected to a suitable source of coolant for this purpose. Preferably, primary sleeve 74 is provided on the axially opposite sides of coolant tubing 88 with a pair of flux intensifiers 75. Each of the intensifiers 75 extends from a side of tubing 88 to the corresponding side edge of sleeve 74 and circumferentially of the sleeve between the outer sides of conductor plates 78 and 80. Intensifiers 75 are of the same material as intensifiers 33 referred to hereinabove, and the intensifiers 33 and 75 are cooperable during operation of the apparatus to increase the efficiency of inducing current in secondary ring 72.

Figure 4A:
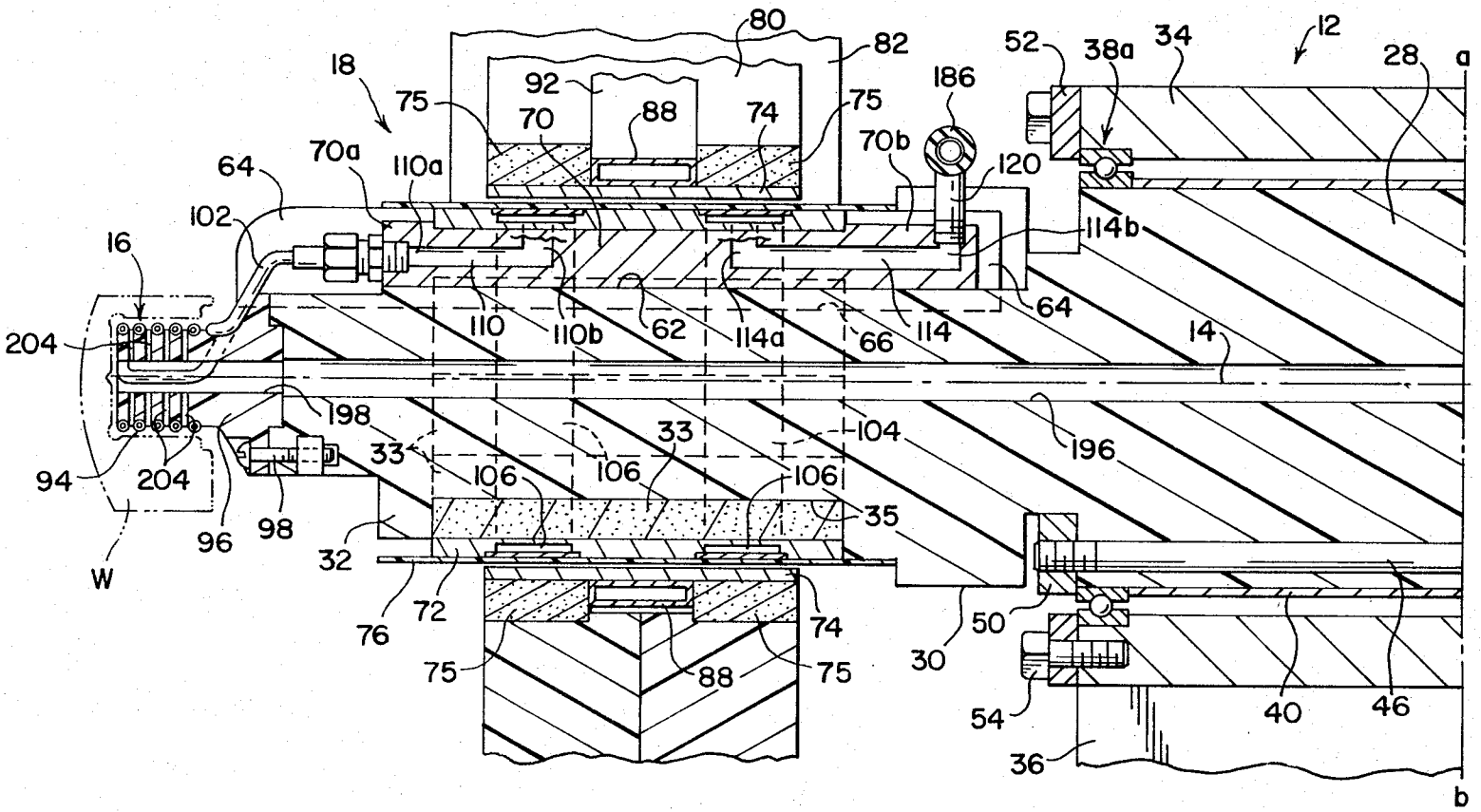
FIGS. 4A and 4B together provide an enlarged sectional view taken along line 4—4 in FIG. 2.
Figure 4B:
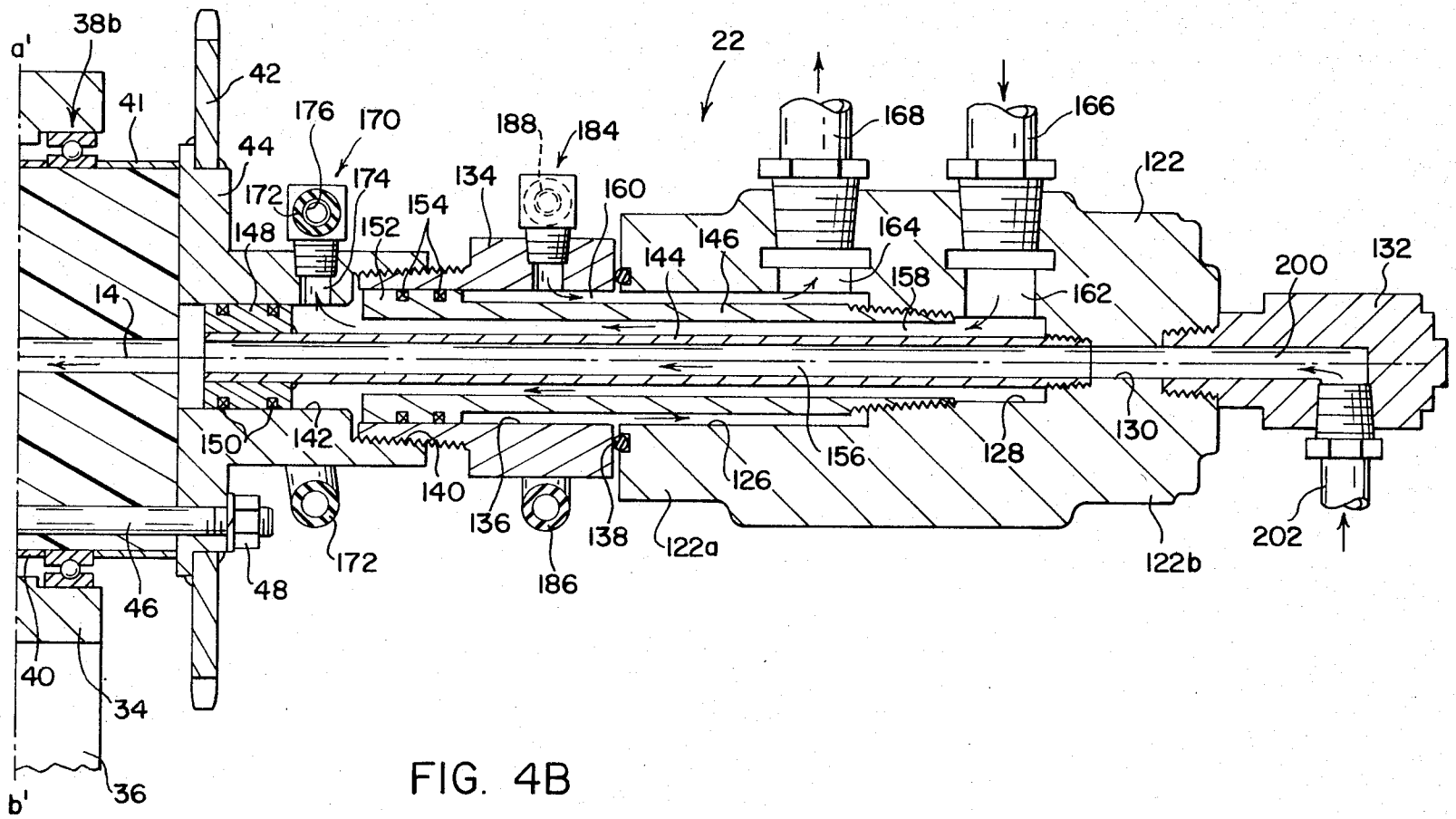
Figure 5:
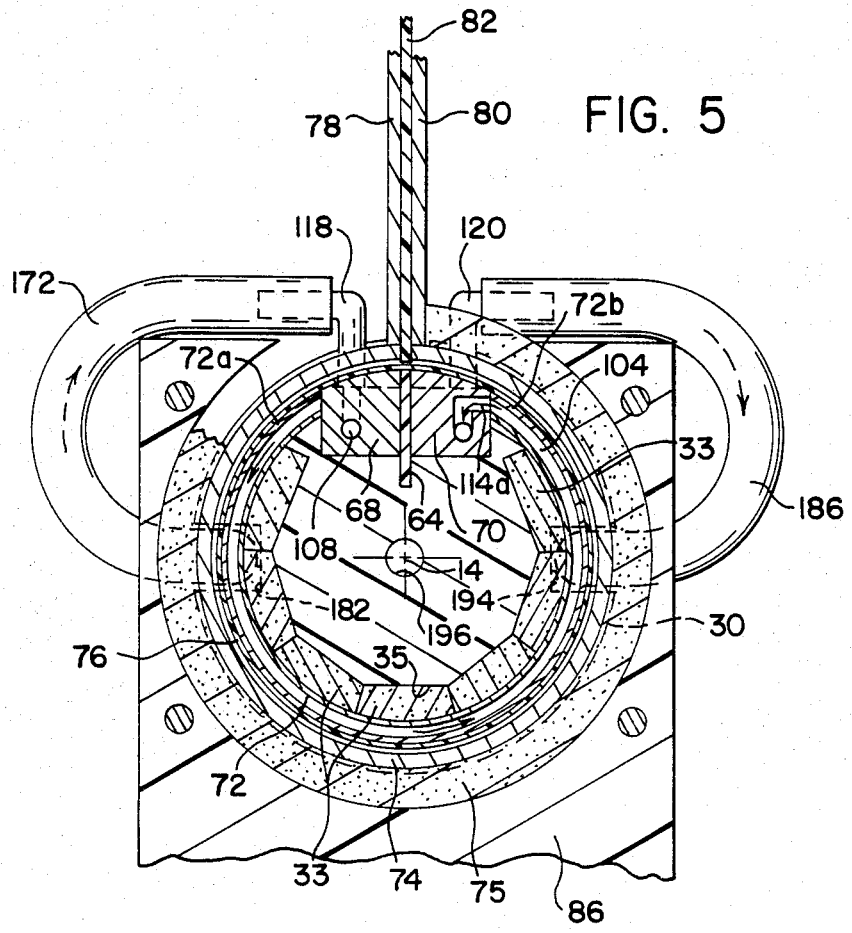
FIG. 5 is a sectional elevation view taken along line 5—5 in FIG. 1.
Figure 6:
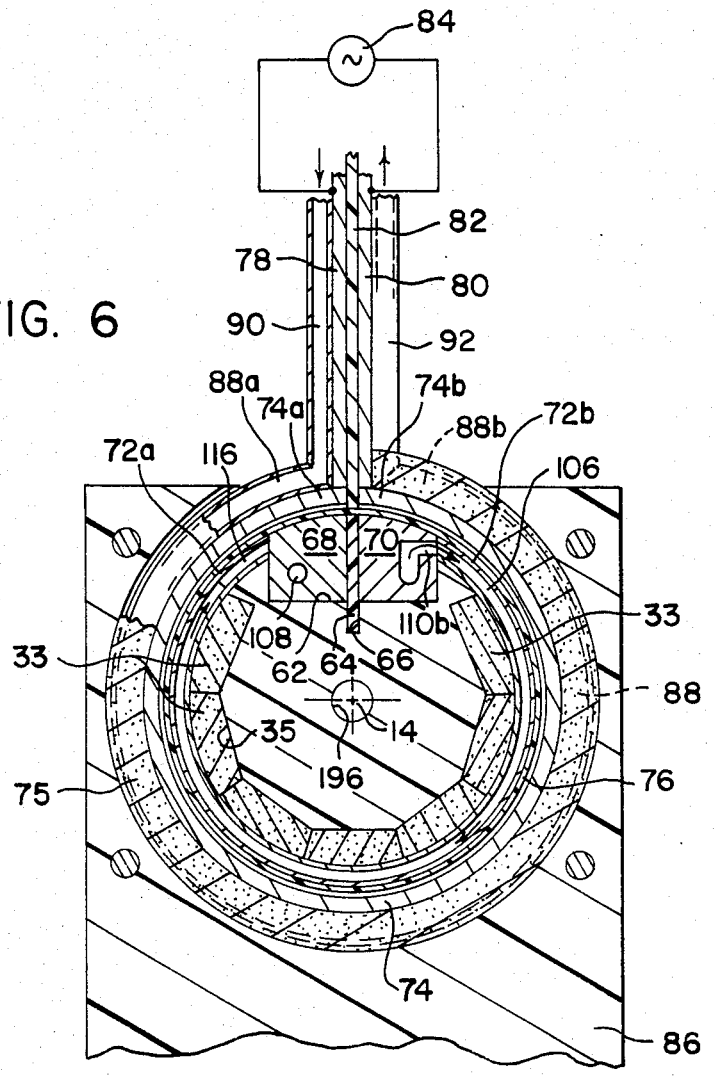
FIG. 6 is a sectional elevation view taken along line 6—6 in FIG. 1.
Figure 7:
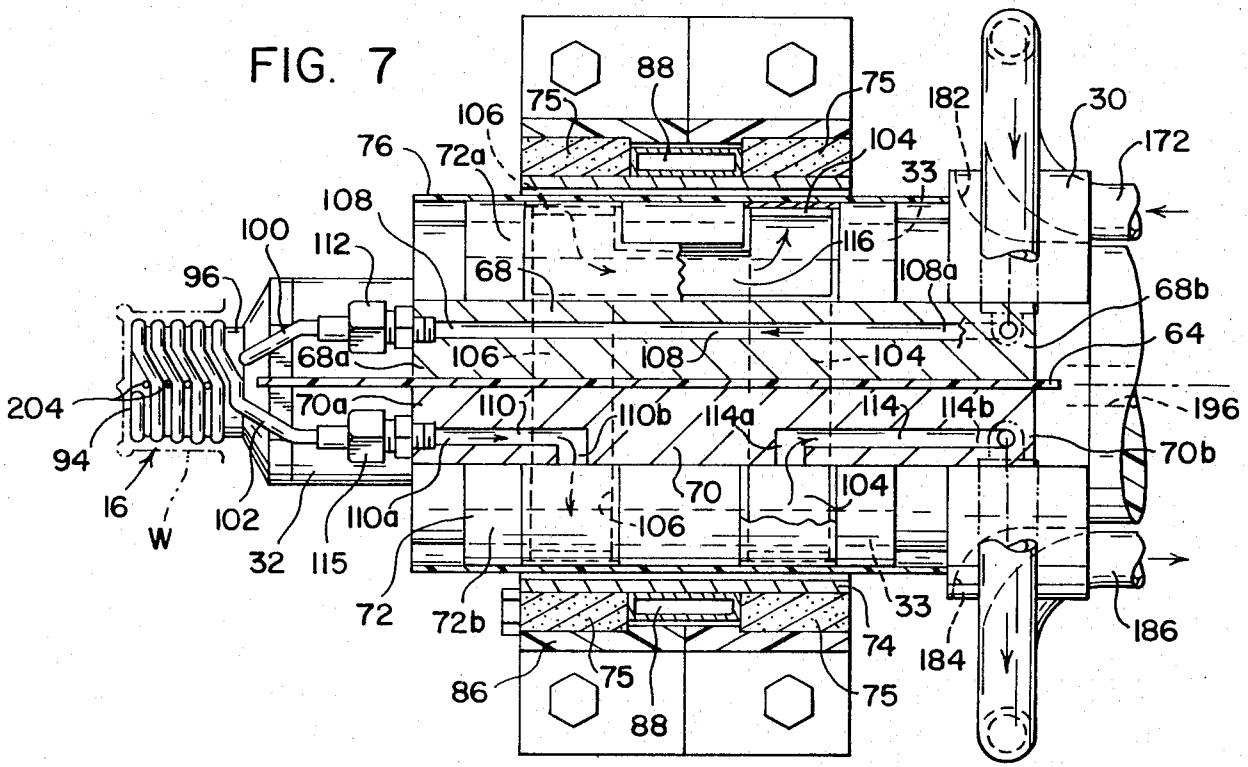
FIG. 7 is a plan view, in section, taken along line 7—7 in FIG. 1; and, FIG. 8 is a sectional elevation view taken along line 8—8 in FIG. 1.

In the embodiment shown, inductor unit 16 includes a multi-turn circular inductor coil 94 of tubular copper material and a matingly contoured mounting block 96 therefor and which is of suitable insulating material. Mounting block 96 is removably secured to the outer end of spindle portion 32 by means of a plurality of threaded fasteners 98, and coil 94 has ends 100 and 102 electrically coupled to ends 68*a* and 70*a* of conductor bars 68 and 70, respectively. To facilitate the circulation of cooling liquid through secondary plate 72 and inductor coil 94, and as best seen in FIGS. 4A and 5–7, secondary plate 72 is provided adjacent the axially inner end thereof with a circumferentially extending passageway 104 and adjacent the axially outer end thereof with a circumferentially extending passageway 106, both of which passageways extend circumferentially from end 72*a* of plate 72 to end 72*b* thereof. Conductor bar 68 is provided with a flow passageway 108 having an inlet end 108*a* connected to a coolant supply line as described more fully hereinafter. Passageway 108 has an outlet end 108*b* in flow communication with end 100 of coil 94 by means of a suitable compression fitting 112. Conductor bar 70 is provided with an axially extending passageway 110 having an inlet end 110*a* in flow communication with end 102 of coil 94 by means of a compression fitting 115. Passageway 110 has an outlet end 110*b* opening through the laterally outer side thereof and into the corresponding end of passageway 106 in plate 72. Conductor bar 70 further includes a passageway 114 adjacent end 70*b* thereof and having an inlet end 114*a* opening laterally outwardly therethrough and into the corresponding end of passageway 104 in plate 72. Passageway 114 has an outlet end 114*b* adjacent end 70*b* of conductor bar 70 and which is connected to a coolant return line as described hereinafter. Additionally, as best seen in FIGS. 6 and 7, secondary plate 72 has a passageway 116 in end 72*a* thereof providing flow communication between the corresponding ends of passageways 104 and 106 in secondary plate 72. Thus, it will be appreciated that a cooling liquid such as water is adapted to flow into passageway 108 through entrance end 108*a* thereof and through outlet end 108*b* thereof into end 100 of coil 94 and through the coil to end 102 thereof. The coolant then flows through passageway 110 in conductor bar 70 through entrance end 110*a* thereof and through outlet end 110*b* thereof into the corresponding end of plate passageway 106 and thence circumferentially through passageway 106 to the opposite end thereof. The cooling water then flows through passageway 116 to the corresponding end of passageway 104 in plate 72 and thence circumferentially through the latter passageway to the end thereof adjacent inlet end 114*a* of passageway 114. The collant then flows through passageway 114 in conductor bar 70 to outlet end 114*b* thereof.

A tubular inlet line 118 is mounted on conductor bar 68 to extend upwardly through collar 30 and laterally outwardly thereof and is in flow communication with inlet end 108*a* of passageway 108. Similarly, a tubular outlet line 120 is mounted on conductor bar 70 to extend upwardly through collar 30 and laterally outwardly thereof and is in flow communication with outlet end 114*b* of passageway 114. Circulation of coolant through the conductor bars, secondary plate and inductor as described hereinabove is achieved by connecting inlet line 118 and outlet line 120 respectively to coolant supply and return lines and, in accordance with the preferred embodiment, the latter is achieved through hydraulic coupling unit 22. More particularly in this respect, and as best seen in FIGS. 1, 2, 4B, 5 and 8 of the drawing, hydraulic coupling unit 22 includes a body portion 122 connected as described hereinafter to suitable fluid supply and return lines which restrain rotation of body portion 122 with the spindle 12. Body portion 122 is provided with an axially extending and radially stepped bore including a larger diameter bore 126 at the axially inner end 122*a* thereof, an intermediate diameter bore 128 axially outwardly adjacent bore 126, and a smaller diameter bore 130 opening through the axially outer end 122*b* of body portion 122. For the purpose set forth hereinafter, bore 130 is connected to a source of cooling and quenching liquid by means of a coupling member 132 mounted on the axially outer end of body portion 122 for displacement therewith. The hydraulic coupling further includes a coupling sleeve member 134 adjacent the axially inner end of body portion 122 and having a bore 136 therethrough corresponding in diameter to bore 126. Coupling member 134 is rotatable relative to body portion 122, and a seal arrangement 138 therebetween facilitates such relative rotation without fluid leakage. Hub member 44 of drive unit 20 is provided with a radially stepped bore including an axially outer portion 140 and an axially inner portion 142. Bore 140 is internally threaded to receive the corresponding externally threaded end of coupling member 134, whereby it will be appreciated that coupling member 134 rotates with hub member 44 in response to rotation of the latter.

Coupling unit 22 further includes radially inner and outer coaxial sleeves 144 and 146, respectively, the axially outer ends of which are respectively threadedly interengaged with portions of bores 130 and 128, whereby the sleeves are fixed to body portion 122 against rotation relative thereto. A collar 148 is secured to the axially inner end of sleeve 144 and is provided with circumferentially extending seal rings 150 which slidably and sealingly engage the inner surface of bore 142. Similarly, the axially inner end of sleeve 146 includes a radially enlarged collar 152 provided with circumferentially extending seal rings 154 which slidably and sealingly engage the inner surface of bore 136. Inner sleeve 144 provides a central passageway 156 through the hydraulic coupling unit for the purpose set forth hereinafter, and sleeves 144 and 146 provide an axially extending annular passageway 158 between the axially outer ends of the sleeves and collar 148 at the axially inner end of sleeve 144. Similarly, sleeve 146 and bore 126 provide an axially extending annular passageway 160 between the axially outer end of sleeve 136 and collar portion 152 on the axially inner end of the sleeve.

Body portion 122 of the coupling unit is provided with a radially extending inlet passageway 162 opening into the axially outer end of passageway 158 and a radially extending outlet passageway 164 opening into the axially outer end of annular passageway 160. A flexible cooling water supply line 166 is suitably coupled with inlet passageway 162 and is connected to a source of water under pressure, not shown, and a flexible return line 168 is likewise suitably coupled with outlet passageway 164 to provide outlet or return flow of the coolant after circulation thereof through the secondary plate and inductor.

Figure 8:
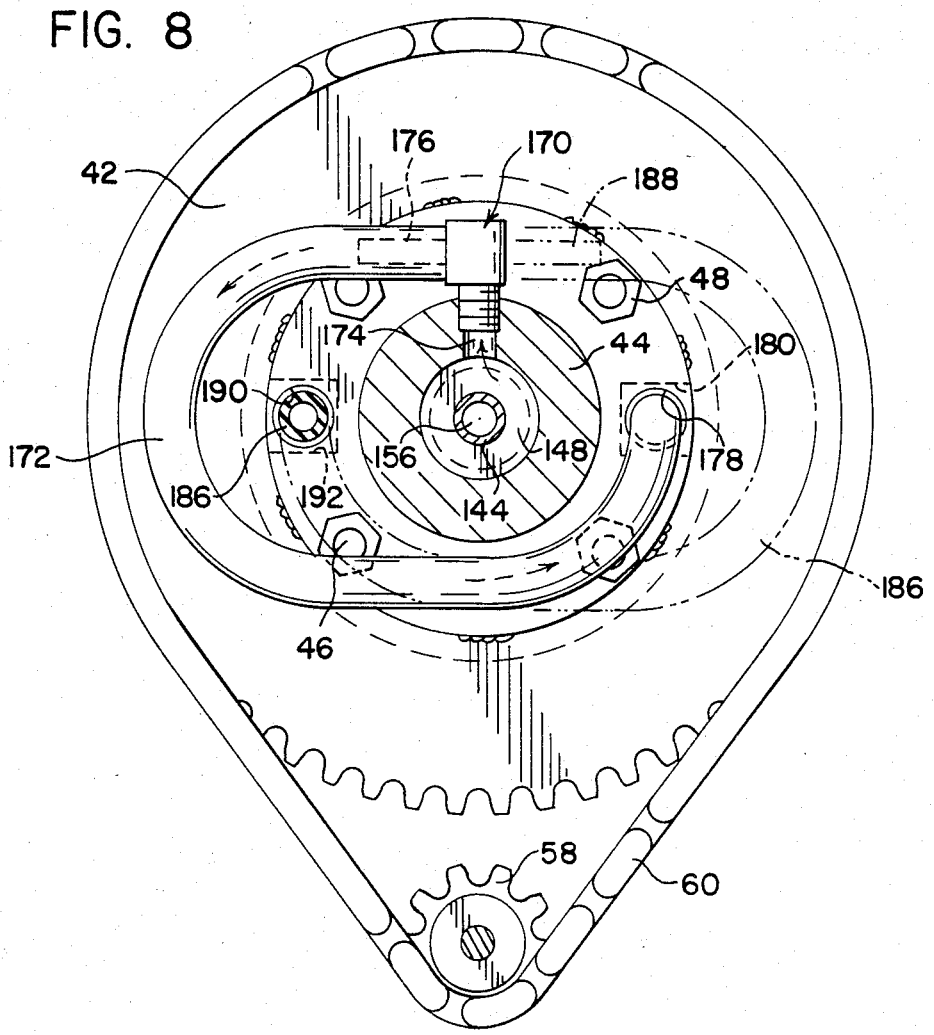

Water flowing into the hydraulic coupling unit through inlet line 166 is delivered to inlet line 118 associated with conductor block 68 by means of a coupling 170 mounted on hub 44 and a hose 172 extending between and having its opposite ends connected to coupling 170 and inlet line 118 of conductor bar 68. More particularly in this respect, coupling 170 is in flow communication with the axially inner end of annular passageway 158 by means of a bore 174 opening radially outwardly through hub 44, and has an outlet stem 176 extending laterally outwardly in one direction relative to axis 14 and receiving the corresponding end of hose 172. As seen in FIG. 8, hose 172 extends counterclockwise from stem 176 three-quarters of the way around hub 44 and thence axially forwardly through an opening 178 provided therefor in the hub, a longitudinally extending recess 180 provided therefor in the corresponding side of spindle portion 28, and a corresponding recess 182 in collar portion 30 of the spindle. As seen in FIG. 5, hose 172 then extends radially outwardly from recess 182 and upwardly and inwardly for the end thereof to be received on inlet line 118. Return flow through return line 168 is achieved by means of a coupling 184 mounted on coupling sleeve 134 and a hose 186 having its opposite ends extending between and connected to coupling 184 and outlet line 120 associated with conductor bar 70. Coupling 184 is in flow communication with the axially inner end of annular passageway 160 and includes a stem 188 extending laterally outwardly of axis 14 in the direction opposite that of stem 176. Stem 188 receives the corresponding end of hose 186 and, as seen in FIG. 8, hose 186 extends clockwise from stem 188 three-fourths of the way around hub 44 and thence through an opening 190 through the hub, a longitudinally extending recess 192 provided for the hose in spindle portion 28, and a corresponding recess 194 provided in collar portion 30 of the spindle. As seen in FIG. 5, hose 186 then extends radially outwardly from recess 194 and upwardly and inwardly for the corresponding end of the hose to be received on outlet line 120. Accordingly, it will will be appreciated that supply water entering line 166 flows through annular passageway 158 and thence into hose 172 through coupling 170, and through hose 172 to inlet line 118. The water then flows through conductor bar 68 to inductor coil 94 and then into conductor bar 70 for circulation through secondary plate 72 to outlet line 120, as described hereinabove. It will be further appreciated that return flow from outlet line 120 is through hose 186 to coupling 184 and thence through annular passageway 160 to return line 168.

In the preferred embodiment, spindle 10 is provided with a central passageway 196 extending completely therethrough for supplying cooling and quenching liquid to a workpiece being heated and, for this purpose, inductor mounting block 96 is provided with a central passageway 198 extending completely therethrough. From FIG. 4B and the description hereinabove of coupling unit 22, it will be appreciated that passageway 130 in body portion 122 and sleeve 144 together provide a central passageway through the coupling unit which opens into passageway 196 at the axially inner end of spindle portion 28. Coupling member 132 on the axially outer end of body portion 122 is provided with a passageway 200 having an entrance end opening laterally through the coupling member for connection with a flexible supply line 202 connected to a suitable source of fluid under pressure, not shown. It will be appreciated that such supply through line 202 is through suitable controls enabling the selective flow for cooling and quenching purposes. Preferably, as best seen in FIG. 4A, inductor mounting block 96 is provided with a plurality of radially extending passageways 204 extending radially therethrough between the convolutions of coil 94 and having inner ends communicating with passageway 198, whereby the flow of cooling and quenching water is both axially and radially outwardly relative to the inductor.

It is believed that the operation of the apparatus will be apparent from the foregoing description. Briefly in this respect, however, it will be understood that workpiece W and spindle 10 are initially axially spaced apart with coil 94 out of magnetically coupled relationship with respect to the interior surface of the workpiece. It will be further understood that workpiece W is held stationary against rotation and in coaxial alignment with the spindle unit and that, when induction heating of the workpiece is to be performed, slide plate 24 is axially displaced toward the workpiece by actuation of slide drive unit 26. Such displacement moves the entire apparatus as a unit a distance corresponding to that required to bring coil 94 into magnetically coupled relationship with the interior surface of workpiece W. In connection with such movement of slide 24, drive unit 20 is actuated to rotate spindle 10 and the inductor is energized through power unit 18 to achieve induction heating of the workpiece. Following the latter, cooling and quenching water flows through line 202 and through the spindle unit for axial and radial discharge against the interior surface of the heated workpiece. During or following such quench water flow, slide drive unit 26 is actuated to displace the apparatus axially away from the workpiece and to its initial position. The circulation of water through the primary tubing and through the conductor bars, secondary plate and inductor is continuous throughout operation of the apparatus.

While particular emphasis has been placed herein on the structure and structural interrelationship between the component parts of the preferred embodiment of apparatus according to the present invention, it will be appreciated that other embodiments as well as changes in the preferred embodiment can be made without departing from the principles of the present invention. Especially in this respect, it will be appreciated that the configuration of the inductor coil as well as the number of turns thereof will vary in accordance with the configuration and size of the workpiece. Further in connection with the coil configuration, it will be appreciated that the latter could readily be configured for the inductor to heat a conical workpiece surface as opposed to the cylindrical surface as shown herein, or an external surface as opposed to an internal surface. Further, while the primary surrounding the secondary plate on the spindle is shown herein as a split-ring of plate material and correspondingly contoured tubing for circulating coolant about the primary, it will be appreciated that the primary could be defined by a loop or loops of such tubing alone, the opposite ends of which would be connected across the power source and to a source for circulating cooling water therethrough. These and other modifications of the preferred embodiment will be obvious and suggested to those skilled in the art upon reading the foregoing description of the preferred embodiment, whereby it is to be distinctly understood that the descriptive matter herein is to be interpreted merely as illustrative of the invention and not as a limitation.

Having thus described the invention, it is claimed:

1. Apparatus for inductively heating a non-rotating workpiece having an axis and a surface concentric therewith, comprising spindle means of insulating material having an axis and axially opposite ends, axially reciprocable slide means, means including said slide means supporting said spindle means for rotation about said axis, inductor means supported on one of said ends of said spindle means for rotation therewith, means providing a primary winding spaced radially outwardly of and extending about said spindle means and having ends connectable across a source of alternating current, means including said slide means supporting said primary winding in axially fixed and concentric relationship with said spindle means, plate means extending about said spindle means between said opposite ends thereof and providing a secondary winding concentric with said spindle axis and supported on said spindle means for rotation therewith, said plate means having circumferentially opposite ends, said inductor means having opposite ends each electrically connected to a different one of said opposite ends of said plate means, means for rotating said spindle means during energization of said primary winding, and means to reciprocate said slide means to selectively bring said inductor means and workpiece surface into magnetically coupled relationship, whereby said workpiece is inductively heated in response to rotation of said spindle means and energization of said primary winding.

2. Apparatus according to claim 1, and flux intensifying means between said spindle means and said plate means and radially outwardly about said means providing said primary winding.

3. Apparatus according to claim 1, wherein said plate means providing said secondary winding includes coolant passageway means having inlet and outlet ends, said inductor means being tubular between said opposite ends thereof and serially connected with said passageway means, and means including fluid coupling means at the other of said opposite ends of said spindle means for connecting said inlet and outlet ends with a source of cooling liquid.

4. Apparatus according to claim 3, wherein said means including fluid coupling means includes means providing fluid inlet and outlet lines supported by said spindle means for rotation therewith, said inlet and outlet lines having first ends respectively connected in flow communication with said inlet and outlet ends of said coolant passageway means and second ends in flow communication with said coupling means at said other end of said spindle means.

5. Apparatus according to claim 3, wherein said spindle means includes passageway means therethrough between said opposite ends thereof and coaxial with said spindle axis, said inductor means including an inductor coil coaxial with said spindle axis and surrounding said spindle passageway means at said one end thereof, and said fluid coupling means including means connecting said spindle passageway means with a source of cooling liquid for flow through said one end of said spindle means.

6. Apparatus according to claim 5, wherein said spindle means includes a plurality of flow ports at said one end extending radially therethrough from said spindle passageway for directing coolant flow radially outwardly of said coil.

7. Apparatus according to claim 3, and flux intensifying means between said spindle means and said plate means and radially outwardly about said means providing said primary winding.

8. Apparatus according to claim 1, wherein said spindle means includes a planar surface extending axially inwardly from said one end thereof, said surface being parallel to and radially spaced from said spindle axis, first and second conductor bars extending axially along said surface in laterally spaced apart and insulated relationship, said opposite ends of said plate means being electrically connected each to a different one of said first and second conductor bars, each of said conductor bars having an axially outer end facing said one end of said spindle means, and said opposite ends of said inductor means being electrically coupled with the outer end of a corresponding one of said conductor bars.

9. Apparatus according to claim 8, wherein said inductor means is tubular between said opposite ends, and said plate means and conductor bars include coolant passageways therein for circulating coolant through said plate means, conductor bars and inductor means.

10. Apparatus according to claim 9, wherein said coolant passageways in said conductor bars includes an inlet passageway in one of said bars and an outlet passageway in the other, and means including fluid coupling means at the other of said opposite ends of said spindle means for connecting said inlet and outlet ends with a source of cooling liquid.

11. Apparatus according to claim 10, wherein said means including fluid coupling means includes means providing fluid inlet and outlet lines supported by said spindle means for rotation therewith, said inlet and outlet lines having first ends respectively connected in flow communication with said inlet and outlet passageways in said conductor bars and second ends in flow communication with said coupling means at said other end of said spindle means.

12. Apparatus according to claim 11, wherein said spindle means includes passageway means therethrough between said opposite ends thereof and coaxial with said spindle axis, said inductor means including an inductor coil coaxial with said spindle axis and surrounding said spindle passageway means at said one end thereof, and said fluid coupling means including means connecting said spindle passageway means with a source of cooling liquid for flow through said one end of said spindle means.

13. Apparatus according to claim 12, wherein said spindle means includes a plurality of flow ports at said one end extending radially therethrough from said spindle passageway for directing coolant flow radially outwardly of said coil.

14. Apparatus according to claim 13, wherein said means providing said primary winding includes plate means having opposite ends and coolant conduit means on said plate means between said opposite ends thereof.

15. Apparatus according to claim 14, and further including first flux intensifying means between said spindle means and said plate means providing said secondary winding and second flux intensifying means about said plate means providing said primary winding.

16. Apparatus according to claim 1, wherein said means supporting said spindle means for rotation includes bearing sleeve means extending about said spindle means adjacent the other of said opposite ends thereof, and said means providing said primary and secondary windings are between said bearing sleeve means and said one end of said spindle means.

17. Apparatus according to claim 16, wherein said plate means providing said secondary winding includes coolant passageway means having inlet and outlet ends, said inductor means being tubular between said opposite ends thereof and serially connected with said passageway means, and means including fluid coupling means at the other of said opposite ends of said spindle means for connecting said inlet and outlet ends with a source of cooling liquid.

18. Apparatus according to claim 17, wherein said spindle means includes passageway means therethrough between said opposite ends thereof and coaxial with said spindle axis, said inductor means including an inductor coil coaxial with said spindle axis and surrounding said spindle passageway means at said one end thereof, and said fluid coupling means including means connecting said spindle passageway means with a source of cooling liquid for flow through said one end of said spindle means.

19. Apparatus according to claim 16, wherein said means providing said primary winding is plate means having opposite ends and coolant conduit means on said plate means between said opposite ends thereof.

20. Apparatus according to claim 19, and further including first flux intensifying means between said spindle means and said plate means providing said secondary winding and second flux intensifying means about said plate means providing said primary winding.

21. Apparatus according to claim 16, wherein said spindle means includes a planar surface extending axially inwardly from said one end thereof, said surface being parallel to and radially spaced from said spindle axis, first and second conductor bars extending axially along said surface in laterally spaced apart and insulated relationship, said opposite ends of said plate means being electrically connected each to a different one of said first and second conductor bars, each of said conductor bars having an axially outer end facing said one end of said spindle means, and said opposite ends of said inductor means being electrically coupled with the outer end of a corresponding one of said conductor bars.

22. Apparatus according to claim 21, wherein said inductor means is tubular between said opposite ends, said plate means and conductor bars including coolant passageways therein for circulating coolant through said plate means, conductor bars and inductor means, said coolant passageways in said conductor bars including an inlet passageway in one of said bars and an outlet passageway in the other, and means including fluid coupling means at the other of said opposite ends of said spindle means for connecting said inlet and outlet ends with a source of cooling liquid.

23. Apparatus according to claim 22, wherein said means providing said primary winding is plate means having opposite ends and coolant conduit means on said plate means between said opposite ends thereof, including first flux intensifying means between said spindle means and said plate means providing said secondary winding and second flux intensifying means about said plate means providing said primary winding.

24. Apparatus according to claim 22, wherein said spindle means includes diametrically opposed recesses extending axially thereof beyond the axially opposite ends of said bearing sleeve means, said means including fluid coupling means including means providing fluid inlet and outlet lines supported by said spindle means for rotation therewith, said inlet and outlet lines having first ends respectively connected in flow communication with said inlet and outlet passageways in said conductor bars, said inlet and outlet lines each including a portion extending from the first end thereof through a corresponding one of said conductor bars.

25. Apparatus according to claim 25, wherein said spindle means includes passageway means therethrough between said opposite ends thereof and coaxial with said spindle axis, said inductor means including an inductor coil coaxial with said spindle axis and surrounding said spindle passageway means at said one end thereof, and said fluid coupling means including means connecting said spindle passageway means with a source of cooling liquid for flow through said one end of said spindle means, and said spindle means including a plurality of flow ports at said one end extending radially therethrough from said spindle passageway for directing coolant flow radially outwardly of said coil.

26. An apparatus for inductively heating a stationary workpiece having a cylindrical surface concentrically formed about an axis comprising:

support means fixed with respect to said workpiece;

spindle means carried by said support means for rotation about an axis coaxial with the axis of the workpiece;

an inductor coil fixedly coaxially carried by said spindle means and having a heating position adjacent said surface of said workpiece in a magnetically coupled relationship therewith;

transformer means having a primary winding and a secondary winding;

means for fixedly mounting said secondary winding on said spindle means concentric with said axis of said spindle means;

means for fixedly mounting said primary winding on said support means concentric with said axis of said workpiece; and, power supply means for energizing said primary winding;

means for cojointly rotating said spindle means, said secondary winding and said inductor coil about said axis when said primary winding is energized by said power supply means, whereby said workpiece is inductively heated during energization of said power supply and rotation of said inductor coil.

* * * * *